United States Patent [19]

Ostler et al.

[11] 4,390,154

[45] Jun. 28, 1983

[54] CORRUGATED PAPERBOARD PALLET DECK

[75] Inventors: Charles R. Ostler; William A. Hampton, both of Anderson, Ind.

[73] Assignee: Container Corporation of America, Chicago, Ill.

[21] Appl. No.: 307,370

[22] Filed: Oct. 1, 1981

[51] Int. Cl.[3] ..... B65D 19/34

[52] U.S. Cl. ..... 248/346; 108/51.3

[58] Field of Search ..... 248/346; 108/51.3; 229/87 R, 87 J, 75; 206/386, 600; 220/441

[56] References Cited

U.S. PATENT DOCUMENTS

| | | | |
|---|---|---|---|
| 1,583,980 | 5/1926 | Leibing et al. | 229/87 R |
| 1,685,813 | 10/1928 | Greve | 229/87 R |
| 2,918,242 | 12/1959 | Olivette et al. | 248/346 X |
| 2,996,276 | 8/1961 | Sorensen et al. | 108/51.3 |
| 4,022,135 | 5/1977 | Bauman, Jr. et al. | 108/51.3 |
| 4,331,234 | 5/1982 | Gilbert | 206/600 X |

*Primary Examiner*—William E. Lyddane

*Attorney, Agent, or Firm*—Richard W. Carpenter; Davis Chin

[57] ABSTRACT

A two-ply corrugated paperboard pallet deck wherein the corrugations of one ply extend at right angles to the corrugations of the other ply.

1 Claim, 5 Drawing Figures

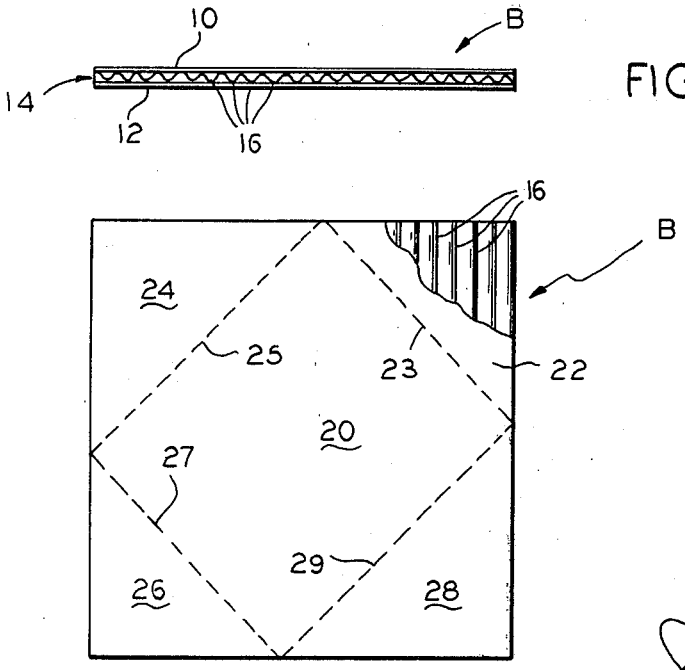
FIG. 1
FIG. 2
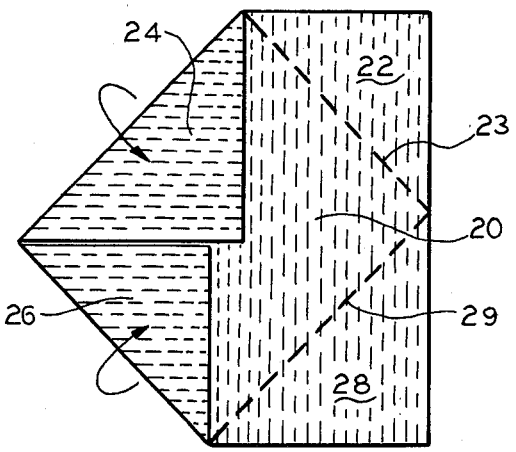
FIG. 3
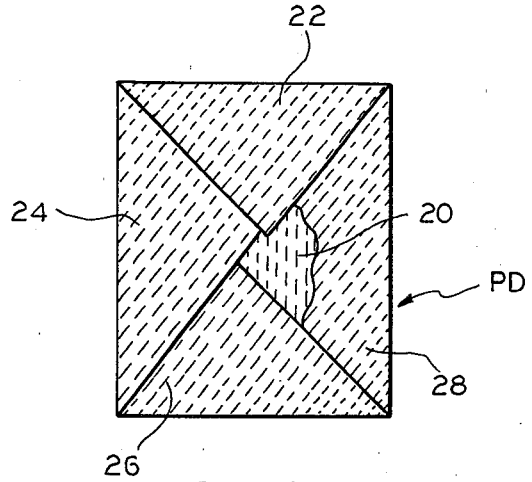
FIG. 4
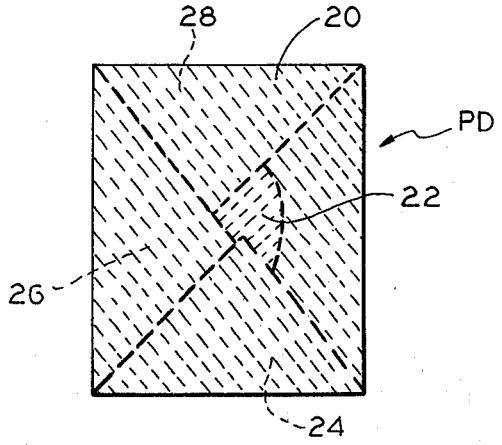
FIG. 5

CORRUGATED PAPERBOARD PALLET DECK

BACKGROUND OF THE INVENTION

1. Field of the Invention

This invention relates generally to paperboard pallets, and more particularly to the construction of a pallet deck formed of corrugated paperboard.

2. Description of the Prior Art

A prior art search directed to the subject matter of this application in the United States Patent and Trademark Office revealed the following patents: U.S. Pat. Nos. 520,366; 1,620,174; 1,845,891; 2,476,197; 2,589,604; 3,215,331; 3,780,854; Swiss Pat. No. 602,431.

None of the prior art patents uncovered in the search discloses a paperboard pallet deck formed of a main panel and flaps folded over and secured to the main panel to form a two-ply construction wherein the corrugations or flutes of one ply are disposed in a direction normal to the flutes of the other ply.

SUMMARY OF THE INVENTION

This invention relates to paperboard pallets and more particularly to decks for paperboard pallets which are formed of corrugated paperboard.

It is an object of the invention to provide a deck structure of corrugated paperboard that is reinforced and has the maximum amount of strength for the amount of material employed to form the deck.

A more specific object of the invention is to provide a corrugated paperboard pallet deck comprising two-plies of paperboard wherein the corrugations of one of the plies extends at right angles to the corrugations of the other ply.

These and other objects of the invention will be apparent from an examination of the following description and drawings.

BRIEF DESCRIPTION OF THE DRAWINGS

FIG. 1 is a plan view of a blank of corrugated paperboard from which the pallet deck illustrated in the other views may be formed;

FIG. 2 is a side elevational view of the structure illustrated in FIG. 1;

FIG. 3 is a view similar to FIG. 1 but illustrating one stage in the formation of the pallet deck shown in FIGS. 4 and 5 from the blank of FIG. 1;

FIG. 4 is a plan view, as seen from the bottom, of a pallet deck embodying features of the invention; and FIG. 5 is a plan view, as seen from the top, of a pallet deck embodying features of the invention.

It will be understood that, for purposes of clarity, certain elements may have been intentionally omitted from certain views where they are believed to be illustrated to better advantage in other views.

DESCRIPTION OF THE PREFERRED EMBODIMENT

Referring now to the drawings for a better understanding of the invention it will be seen that the pallet deck, indicated generally at PD in FIGS. 4 and 5, may be formed from a unitary blank B of corrugated paperboard illustrated in FIG. 1.

As best seen in FIGS. 1 and 2, blank B comprises a sheet of corrugated paperboard which preferably includes a pair of flat or non-fluted top and bottom liner layers 10 and 12 between which is sandwiched a median layer 14, which is corrugated and includes a plurality of corrugations or flutes indicated at 16. If desired the pallet deck may be formed from a single-faced sheet of corrugated material having only one liner and one medium layer, or, if desired, additional layers of material can be employed. The basic principle of the invention, as hereinafter described, is equally applicable to various combinations of corrugated paperboard.

As best seen in FIG. 1 pallet deck PD includes a generally rectangular main panel 20 which is located centrally of blank B, but which is laid out so that its side edges are disposed diagonally with respect to the side edges and the corrugations of the blank B.

The pallet deck includes a plurality of generally triangular first, second, third, and fourth flaps 22, 24, 26 and 28 which are disposed at the corners of the blank and which are foldably joined along fold lines 23, 25, 27, and 29, respectively, to the adjacent side edges of main panel 20.

In order to form the pallet deck PD from the blank B the four flaps are folded at 180° along their respective fold lines so as to overlie and be adhesively secured to the underside of main panel 20 as shown in FIGS. 3 and 4. It will be appreciated that because of the angular arrangement of the main panel 20 on blank B when the flaps are folded to overlie the main panel, the corrugations or flutes 16 of the flaps will be disposed at right angles to the corrugations or flutes of main panel 20. This provides increased strength for the pallet deck and enables the construction of a relatively strong pallet deck from a minimum amount of material.

What is claimed is:

1. A paperboard pallet deck formed from a generally rectangular, unitary blank of corrugated paperboard which includes a layer of fluted medium having a flat, non-fluted layer of liner secured to at least one side thereof, said deck comprising:

(a) a generally rectangular main panel, located centrally of the blank with the side edges thereof disposed diagonally with respect to both the side edges of the blank and the flutes of the median layer;

(b) four generally triangular flaps located at the four corners of the blank and being foldably joined to the respective side edges of said main panel;

(c) said flaps each being folded inwardly 180° and secured in face-to-face relation with adjacent portions of said main panel and with their flutes extending in a direction normal to that of the main panel flutes.

* * * * *